United States Patent [19]

Rammler et al.

[11] 4,098,674

[45] Jul. 4, 1978

[54] RECOVERY OF HYDROCARBONACEOUS MATERIAL FROM TAR SANDS

[75] Inventors: Roland Rammler, Königstein; Paul Schmalfeld, Bad Homburg; Hans-Jürgen Weiss, Frankfurt am Main, all of Germany

[73] Assignee: Metallgesellschaft Aktiengesellschaft, Frankfurt am Main, Germany

[21] Appl. No.: 782,472

[22] Filed: Mar. 28, 1977

[30] Foreign Application Priority Data

Apr. 2, 1976 [CA] Canada ..... 249420

[51] Int. Cl.[2] ..... C10G 1/02; C10G 1/04

[52] U.S. Cl. ..... 208/11 R; 208/11 LE

[58] Field of Search ..... 208/11 LE, 11 R

[56] References Cited

U.S. PATENT DOCUMENTS

| | | | |
|---|---|---|---|
| 2,733,193 | 1/1956 | Hatensel | 208/11 R |
| 3,261,775 | 7/1966 | Blaser | 208/11 R |
| 3,466,240 | 9/1969 | Steinmetz | 208/11 LE |
| 3,518,181 | 6/1970 | Tse | 208/11 R |

*Primary Examiner*—Herbert Levine

*Attorney, Agent, or Firm*—Burgess, Dinklage & Sprung

[57] ABSTRACT

The present invention relates to a process for the recovery of hydrocarbonaceous materials from tar sand comprising subjecting a part of the tar sand to hot water extraction by mixing it with hot water, the solids and bitumen being separated and the latter treated further, and carrying out a dry distillation of another part of the tar sand which is thereby heated to temperatures above 400° C, the gaseous and vaporous distillation products being cooled and condensed. This process is characterized in that at least a portion of the thermal energy required for hot water extraction originates in the dry distillation waste heat. This process is further characterized in that the solid coke-like residue recovered from the further treatment of the bitumen from hot water extraction is used as fuel in the dry distillation and in that the wet solids recovered from hot water extraction are mixed with the dry distillation residue to form a solid product which can be transported on belt conveyors.

14 Claims, 1 Drawing Figure

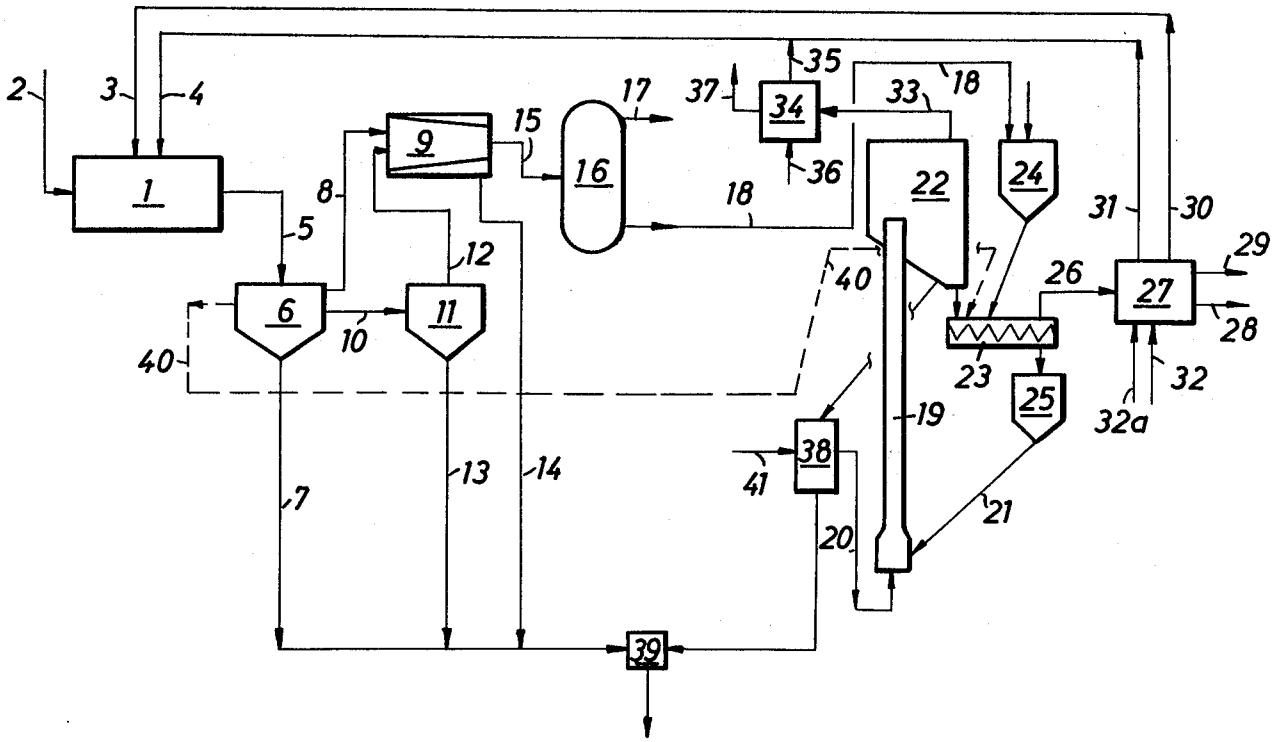
1
2
3
4
5
6
7
8
9
10
11
12
13
14
15
16
17
18
19
20
21
22
23
24
25
26
27
28
29
30
31
32
32a
33
34
35
36
37
38
39
40
41

RECOVERY OF HYDROCARBONACEOUS MATERIAL FROM TAR SANDS

The present invention is directed to a process for the recovery of hydrocarbonaceous materials from tar sand. According to that process, a portion of the tar sand is subjected to hot water extraction and thereby mixed with hot water; solids and bitumen are separated and the latter treated further. Another portion of the tar sand is subjected to dry distillation and thereby heated to temperature above 400° C, the gaseous and vaporous distillation products being cooled and condensed.

It is known to recover the bitumen from tar sand by hot water extraction. This process which has already found its first commercial application in Canada creates in particular environmental pollution problems difficult to solve. Said process yields waste sludge with a high water content and also a considerable proportion of oil. The conversion of the extracted bitumen into hydrocarbons causes the formation of a substantial quantity of coke, for instance, by cracking of the bitumen for example at a temperature of 600° C. In view of the high sulphur content of the starting material the petroleum coke contains a harmful proportion of sulphur and can therefore not be put to a reasonably economic use. In commercial plants using said known process, large quantities of coke are therefore dumped.

The dry distillation of tar sand, oil shale or other bituminous or oil-bearing materials is described, for instance, in the German Pat. Nos. 1,809,874 and 1,909,263 and in the corresponding Canadian Pat. Nos. 920,080 and 928,654. In this process a finely granulated heat carrier, heated to about 600°– 800° C, is mixed with the material to be distilled so that a mixing temperature of above 400° C, usually between 450° and 650° C, is established. At this temperature the bituminous or oil-bearing material is distilled followed by cooling and condensation of the vapors. The finely granulated distillation residue or an external granulated material with a grain size of preferably between 2 and 15 mm can be used as heat carrier. Said known processes yield dry solid residue, and a large portion of the thermal energy can be recovered from the hot gases, vapors and residue.

It is the object of the invention to so perform the recovery of hydrocarbonaceous materials from tar sand that the advantages of the two processes can be utilized in a common plant.

It is another object of the invention to provide a process for the recovery of hydrocarbonaceous materials, which is less polluting than hot water extraction alone.

According to the invention these objects are achieved in that at least a part of the thermal energy needed for hot water extraction originates in the waste heat of the dry distillation process. This waste heat can be used mainly for the generation of hot water and steam for hot water extraction.

According to a preferred embodiment, at least a part of the hot water or steam required for hot water extraction is produced by cooling the dry distillation gases. The heat set free during cooling and condensation of the gaseous and vaporous distillation products can also be utilized for hot water extraction. The process air can also be preheated with process waste heat, preferably from the hot solid residue.

Waste products from the bitumen recovered by hot water extraction can be used advantageously in the dry distillation step. The solid coke residue occurring during cracking of the bitumen from hot water extraction is well suitable for use as additional fuel for heating the retorts for dry distillation. This saves product oil or gas for fueling the retort and thus increases the net oil yield. Any other addtional fuel from an outside source could be used as well.

A special problem arises from the depositing of the soilds occurring during hot water extraction which are, in part, of minute particle size and have a high moisture content. These residues are preferably mixed with the dry residue of the distillation process and thus the moisture content of the total residue adjusted to a workable level. In some cases it may be desirable to produce a pumpable slurry of waste water and distillation residue which is transported to the dump.

A relative tar sand capacity of a dry distillation plant to a hot water extraction plant in accordance with the invention is from about 1:0.3 to 1:1, preferably about 1:1 to 1:2. In the preferred range, the waste heat of the dry distillation section approximately covers the heat requirement for the hot water extraction plant. At a relative capacity of 1:1.6 for example, about 2.8 tons of sludge comprising about 40% water and at 80° C from hot water extraction and 1 ton of distillation residue at 150° C can be mixed and the mixture with less than about 30% moisture and at 85° C can be carried away on belt conveyors.

It is further possible to use the waste water from hot water extraction together with the gas liquor for moistening the dry distillation residue. Furthermore, dry distillation waste water may be used for wettening the distillation residue.

A special variation of the combination of the two processes is that tar sand partly free of solids by hot water treatment is further processed by dry distillation either directly or after previous drying. This concentrated feed material increases the economics of the dry distillation.

As the dry distillation operates above 400° C, preferably in the range from about 450° to 650° C, distillation is accompanied by a quality-increasing thermal treatment (cracking) of the oil which can be controlled by the choice of suitable temperatures and residence times. Therefore, the residence times of the oil vapors in the hot area of the distillation zone are preferably about 0.5 to 10 seconds. The mild cracking reduces the viscosity of the oil to the extent desired. This saves a separate cracking unit which would be required in the absence of this cracking effect.

The invention combined process will be now better understood with reference to the following description of a non-restrictive example, taken in conjunction with the accompanying drawing which is a schematic flow sheet, wherein the left half illustrates the hot water extraction section, and the right half the dry distillation plant which uses distillation residue as heat carrier.

It must be noted that it is possible to utilize fewer than all, but at least one, of the process connections between hot water extraction and dry distillation shown in the description.

Rotary drum 1 is supplied with tar sand through feed line 2, and with hot water and steam through feed lines 3 and 4 respectively, the tar sand being mixed with water and heated. The mixture, through line 5, enters separator 6 where initial separation of liquid and solids takes place.

The bulk of the solids is discharged as a sludge with about 40% water through line 7, while the bituminous material containing little solids and water is withdrawn from separator 6 and supplied through line 8 to a further separation step 9 consisting of centrifuges.

A bitumen/water sludge is withdrawn from the middle of separator 6 and routed through line 10 to a further separator 11 for separation into bitumen and sludge.

The bitumen still containing little dust and water is supplied through line 12 also to separation step 9 where it is purified, jointly with the bitumen coming directly from separator 6, to a dust content of about 1% and a water content of about 5%.

The sludge from separator 11 is withdrawn through line 13. The sludge occurring in separation step 9 is withdrawn through line 14 and combined with the sludge from lines 7 and 13.

The bituminous materials extracted from the tar sand require after-treatment to increase the yield of valuable lowboiling hydrocarbons. Therefore through line 15 they enter coker 16 where they are heated and partially cracked. The heating temperatures range between about 550° and 650° C. The distillate produced in coker 16 passes out line 17. At the same time, a considerable quantity of petroleum coke is produced.

As the starting material usually contains dust and sulphur compounds, the coke produced in coker 16 also contains ash and sulphur. Its further use is therefore problematic, but it can be employed as fuel for the dry distillation of the tar sand which will be described later on. For this purpose the coke, after passing through a grinding and/or screening facility, is supplied preferably through line 18 to storage bin 24 for the dry distillation tar sand feed. It is also possible to supply this coke directly to mixer 23 or to pneumatic conveying pipe 19, which is not shown in the drawing. In the conveying pipe finely granulated solids consisting of circulating heat carrier and freshly produced distillation residue are carried upwards and thereby heated. The heat is supplied by burning carbon already contained in the distillation residue and petroleum coke from coker 16 with the addition of preheated air from line 20. The sulphur content of the coke is not of disadvantage because the distillation residue used as circulating heat carrier usually contains sufficient calcium and/or magnesium oxide to absorb the $SO_2$ formed. When required, some lime and/or dolomite can be added to the feedstock (tar sand).

The distillation residue heated to about 600°–800° C on ascending in pneumatic conveyer pipe 19 enters collecting bin 22 where it is separated from the combustion gases and accumulated in the bin lower section.

The hot distillation residue is fed to mixer 23 which is preferably of the known double-shaft type or a rotary drum. This mixer is also supplied with an appropriate quantity of tar sand from storage bin 24 so that a mixing temperature of about 450°–650° C is established at the end of the mixer. At these temperatures the volatiles are distilled from the tar sand. This devolatilization of the tar sand is continued in downstream post-devolatilizing vessel 25.

The gaseous and vaporous products from the distillation zone proper, namely mixer 23 and vessel 25, are withdrawn through line 26 and, after preliminary dedusting, fed to condensation unit 27 where the desired product oil and gas are recovered and discharged through lines 28 and 29.

The waste heat from condensation unit 27 is utilized for the generation of hot water (line 30) and steam (line 31) from make-up water from line 32 and boiler feed water from line **32*a***.

The combustion gases at about 600°–800° C from collecting bin 22 are fed through line 33 to boiler 34 where steam (line 35) is generated from boiler feed water from line 36, and the combustion gases are cooled. The cooled waste gases leave boiler 34 through line 37 and are finally purified in a dust collector, not shown in the drawing, before they are discharged to atmosphere.

The hot distillation residue is withdrawn from collecting bin 22 and, after cooling in air preheater 38, fed to mixer 39 to which the sludge from hot water extraction from lines 7, 13 and 14 is also charged. Air enters air preheater 38 through line 41 and flows at elevated temperature through line 20 to pneumatic conveying pipe 19. The distillation residue leaves air preheater 38 at about 150°–300° C. As this distillation residue is water-free, it is suitable for mixing with wet residue which takes place in mixer 39. From mixer 39 the residue mixture can, for instance, be carried on belt conveyors to the dump. This eliminates the usual large settling basins for the sludge from hot water extraction which create an ever increasing environmental pollution problem.

The first separation step of hot water extraction consisting of rotary drum 1 and separator 6 yields a beneficiated tar sand from which part of the solids has been removed through line 7. This concentrated intermediate product is equally suitable for further processing in the dry distillation unit. The drawing therefore shows phantom draw-off line 40 which leads to mixer 23 of the dry distillation unit and which indicates the possibility of feeding beneficiated tar sand to dry distillation, either in addition to the crude tar sand or as the sole feed material. Alternatively to the example of the process illustrated in the drawing, line 40 may also run to storage bin 24. Prior to feeding the beneficiated tar sand to dry distillation it can be dewatered at least in part, which is not illustrated in the drawing. This can be done, for instance, on centrifuges or by heating the beneficiated tar sand by the admission of waste heat from dry distillation, distilling the water, condensing the resulting vapors and by separately recovering water and oil from the condensate.

It will be appreciated that the instant specification and examples are set forth by way of illustration and not limitation, and that various modifications and changes may be made without departing from the spirit and scope of the present invention.

What is claimed is:

1. A process for the recovery of hydrocarbonaceous materials from tar sand comprising dividing the tar sand into first and second portions, mixing the first portion with hot water, separating from the mixture wet solids and bituminous hydrocarbonaceous material, subjecting the second portion to dry distillation at a temperature above about 400° C, thereby forming a distillation residue and gaseous and vaporous distillation products, cooling and condensing such gaseous and vaporous distillation products and withdrawing hydrocarbonaceous material therefrom, and effecting a heat exchange between water and at least one member selected from the group consisting of the distillation residue and the gaseous and vaporous distillation products so as to heat the water, the water then being used in the treatment of the first portion.

2. A process for the recovery of hydrocarbonaceous materials from tar sand comprising subjecting a first portion of the tar sand to hot water extraction and thereby mixing it with hot water, at least part of the solids and a bituminous material being separated and the latter being heated and partially cracked thereby producing a distillate of hydrocarbonaceous material and a solid coke-like residue, and carrying out a dry distillation of a second part of the tar sand which is thereby heated to temperatures above 400° C by mixing it with a heated solid granular material thereby forming a distillation residue and gaseous and vaporous distillation products, the gaseous and vaporous distillation products being cooled and condensed, and the solid coke-like residue being used as fuel in the dry distillation.

3. A process for the recovery of hydrocarbonaceous materials from tar sand comprising subjecting a first portion of the tar sand to hot water extraction and thereby mixing it with hot water, the solids and bitumen being separated, and carrying out a dry distillation of a second portion of the tar sand which is thereby heated to temperatures above 400° C by mixing it with heated solid granular material, thereby forming a distillation residue and gaseous and vaporous distillation products, the gaseous and vaporous distillation products being cooled and condensed, and the wet solids recovered from hot water extraction being mixed with dry distillation residue to form a mixture which is transported to a dump.

4. Process of claim 1, wherein at least part of the hot water required for the hot water extraction of the first portion is generated by heat exchange with dry distillation off-gases or gaseous and vaporous distillation products.

5. The process according to claim 1, wherein the bituminous hydrocarbonaceous material is beneficiated and then subjected to dry distillation together with said second portion of tar sand.

6. The process according to claim 5, wherein the beneficiated tar sand is dewatered at least in part before dry distillation.

7. The process according to claim 5, wherein the beneficiated tar sand is heated to the boiling point of the water by the admission of dry distillation waste heat, the resulting vapors are condensed, and oil and water are separately recovered from the condensate.

8. The process according to claim 1, wherein waste water from the hot water extraction is used for wetting the dry distillation residue to be discharged.

9. The process according to claim 3, wherein the mixture transported to a dump is a pumpable slurry of waste water and distillation residue.

10. The process according to claim 1, wherein the dry distillation of the second portion is effected by mixing the tar sand with a hot granulated heat carrier in a distillation chamber, the heat carrier being removed from the chamber and being reheated outside the distillation chamber.

11. The process according to claim 10, wherein the residence time of the oil vapors set free during dry distillation in the hot zone of the distillation chamber is from about 0.5 to 10 seconds.

12. The process according to claim 2, wherein said gaseous and vaporous distillation products are kept in the hot distillation zone for a residence time from about 0.5 to 10 seconds.

13. The process of claim 1, wherein waste water produced by condensing gaseous and vaporous distillation products from said dry distillation is used for wetting a part of said distillation residue before withdrawing said residue from the process.

14. The process according to claim 3, wherein said mixture transported to a dump contains less than about 30% moisture.

* * * * *